US009683575B2

(12) United States Patent
Trottmann

(10) Patent No.: US 9,683,575 B2
(45) Date of Patent: Jun. 20, 2017

(54) PUMP AS WELL AS A RECIRCULATION DEVICE FOR A PUMP

(71) Applicant: Sulzer Pumpen A.G., Winterthur (CH)

(72) Inventor: Benedikt Trottmann, St. Gallen (CH)

(73) Assignee: Sulzer Management AG, Winterthur (CH)

( * ) Notice: Subject to any disclaimer, the term of this patent is extended or adjusted under 35 U.S.C. 154(b) by 1159 days.

(21) Appl. No.: 13/763,554

(22) Filed: Feb. 8, 2013

(65) Prior Publication Data

US 2013/0209226 A1 Aug. 15, 2013

(30) Foreign Application Priority Data

Feb. 10, 2012 (EP) ..... 12154903
Jul. 12, 2012 (EP) ..... 12176181

(51) Int. Cl.
*F04D 13/06* (2006.01)
*F04D 29/06* (2006.01)
*F04D 7/04* (2006.01)

(52) U.S. Cl.
CPC ..... *F04D 29/06* (2013.01); *F04D 7/04* (2013.01); *F04D 29/061* (2013.01)

(58) Field of Classification Search
CPC .... F04D 13/0606; F04D 13/062; F04D 29/06; F04D 29/061; F04D 29/063
USPC ..... 415/111, 121.2
See application file for complete search history.

(56) References Cited

U.S. PATENT DOCUMENTS 2,830,755 A * 4/1958 Anderson ..... F04D 29/063 415/175
2,844,418 A 7/1958 Audemar
3,203,354 A * 8/1965 Pedersen ..... F04D 9/003 415/112
RE26,570 E 4/1969 Dunn et al.
3,867,056 A * 2/1975 Carle ..... F04D 1/06 415/169.1

(Continued)

FOREIGN PATENT DOCUMENTS

CH 557472 12/1974
CH 672007 A5 10/1989

(Continued)

OTHER PUBLICATIONS

European Search Report mailed on Jul. 23, 2012, for EP Patent Application No. 12154903.4, 7 pages.

*Primary Examiner* — Sean J Younger
(74) *Attorney, Agent, or Firm* — Kilpatrick Townsend & Stockton LLP

(57) ABSTRACT

Disclosed is a pump for conveying a pump having a pump rotor rotatably supported about an axis of rotation in a pump stator in the operating state and a rotor shaft is arranged in a shaft leadthrough such that a lubricating film of a lubricating fluid formed from the pump fluid can be formed in a ring gap between the rotor shaft and the shaft leadthrough; and wherein a separation device is provided at the rotor shaft by which a predefinable quantity of an ingredient can be separated from the pump fluid by means of a centrifugal force for providing the lubricating fluid at the ring gap in the operating state, wherein a recirculation device is provided so that a gas can be recirculated with the aid of the separation device.

15 Claims, 3 Drawing Sheets

(56) References Cited

U.S. PATENT DOCUMENTS

Figure 1:
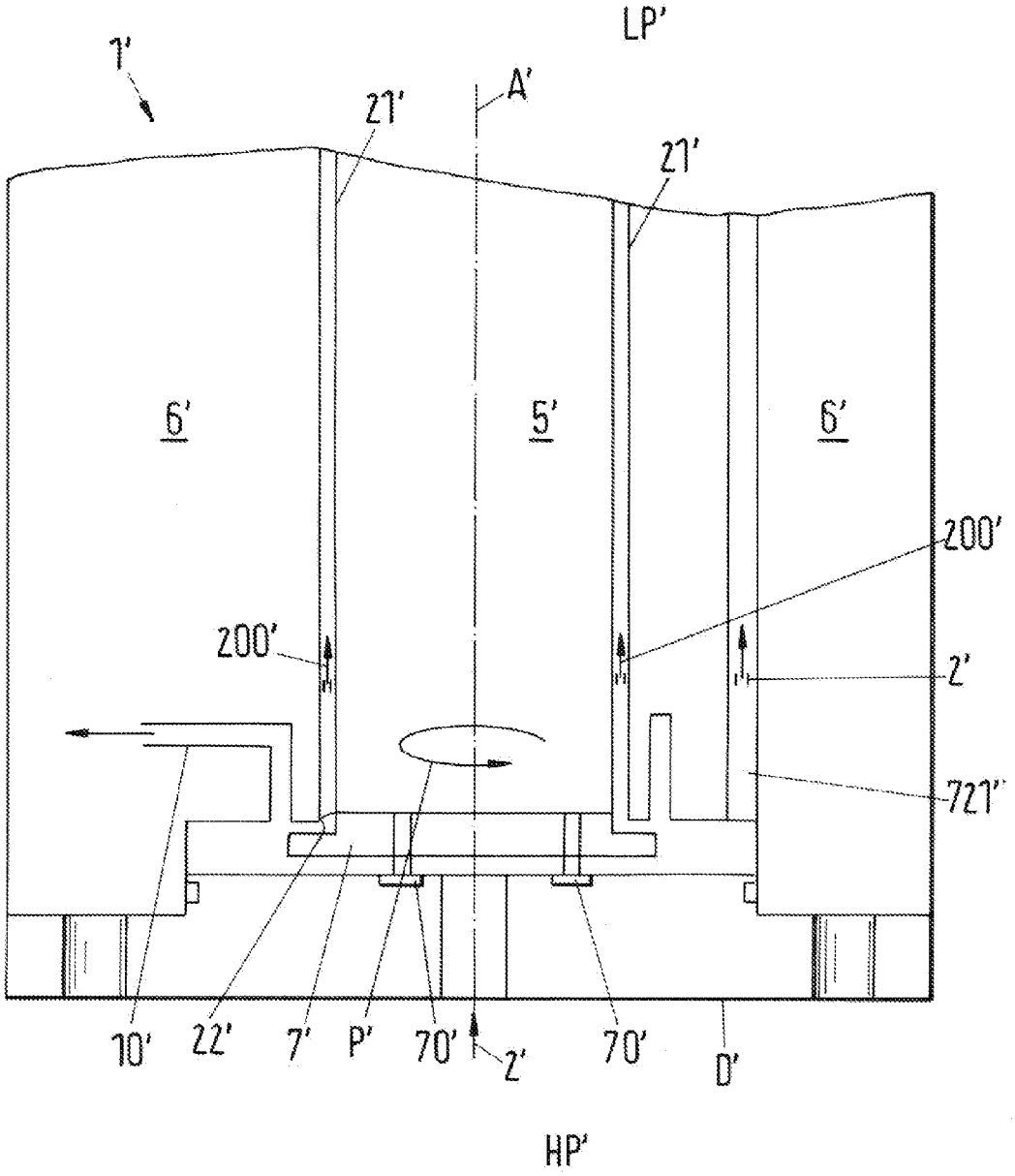

| | | | | | |
|---|---|---|---|---|---|
| 4,333,748 | A * | 6/1982 | Erickson | F16C 33/103 | 415/188 |
| 4,768,936 | A * | 9/1988 | Etemad | F04C 23/008 | 184/6.2 |
| 4,795,321 | A * | 1/1989 | Etemad | F04C 29/0007 | 418/1 |
| 4,795,322 | A * | 1/1989 | Etemad | F04C 29/023 | 418/55.5 |
| 4,811,471 | A * | 3/1989 | Etemad | F04C 23/008 | 29/428 |
| 4,854,831 | A * | 8/1989 | Etemad | F04C 23/008 | 417/366 |
| 4,871,301 | A * | 10/1989 | Buse | F04D 29/0413 | 415/175 |
| 5,118,466 | A * | 6/1992 | Raymond | F04D 29/0413 | 376/361 |
| 5,248,245 | A | 9/1993 | Behnke et al. | | |
| 7,338,252 | B2 * | 3/2008 | Meuter | F04D 7/06 | 415/107 |

FOREIGN PATENT DOCUMENTS

| | | | | |
|---|---|---|---|---|
| DE | 1653738 | A1 | 4/1972 | |
| EP | 0447106 | A2 | 9/1991 | |
| EP | 0447106 | A3 | 9/1991 | |
| GB | 1071266 | A * | 6/1967 | F04D 13/0613 |
| WO | 91/12412 | A1 | 8/1991 | |

* cited by examiner

PUMP AS WELL AS A RECIRCULATION DEVICE FOR A PUMP

This application claims priority to the European Patent Application No. 12154903.4, filed Feb. 10, 2012, and European Patent Application No. 12176181.1filed Jul. 12, 2012, the disclosures of which are incorporated by reference herein.

The invention relates to a pump for conveying a pump fluid in the form of a multiphase mixture as well as to a recirculation device for a pump in accordance with the preamble of independent claims 1 and 15.

It is a well-known measure in the prior art to separate ingredients of the pump fluid by means of the rotating parts of pumps and to lubricate the pump or constrictions, that is ring-shaped seals, using the separated medium itself, which has the obvious advantage that then no specific lubricant has to be provided for these lubrication applications. This can above all be of particular advantage when the provision of the lubricant, e.g. for lubricating a rotating rotor shaft of the pump bearing a pump rotor, is only possible under particular difficulties. A further advantage is that a shaft seal can be dispensed with on the non-drive side due to the use of a self-lubricating or product-lubricated bearing since the shaft no longer has to be led out to the atmosphere. Pumps for conveying multiphase mixtures such as for conveying crude oil can be named as prominent examples in addition to a plurality of further applications. Such pumps frequently have to be operated at locations which are very difficult to access, frequently many hundreds of meters, even up to some thousand meters, beneath the ocean surface, where the pumps have to be operated reliably under extreme conditions over considerable time periods.

A problem which has previously only been solved unsatisfactorily, however, occurs in the conveying of such pump media such as with a multiphase mixture which also contains natural gas and frequently also water and above all damaging solid portions such as sand in addition to crude oil. The additional ingredients are namely frequently rather harmful to the lubrication application. The skilled person thus immediately understands that, for example above all hard ingredients such as sand, can have a hugely negative effect on the lubrication. If, for example, a lubricant contaminated with sand is used for lubricating a rotor shaft of a pump wheel, the sand in the lubricant can cause considerable damage at the parts to be lubricated because the hard sand grains can damage the surfaces of the components to be lubricated which are frequently of comparatively soft metal, which can ultimately result in the failure of the pump.

It is therefore known in the prior art to provide those parts which are lubricated, for example, using a lubricant contaminated with sand with special hardening so that the sand contained in the lubricant cannot damage the surfaces or to reduce the wear of the corresponding parts at least so much that reasonably long operating times, that is economically reasonable service intervals, can be achieved.

In this respect, the hardening of the corresponding parts, e.g. of the rotor shaft of an impeller of the pump or of the static or rotating counterparts and bearing components forming the rotor shaft bearing, is naturally a measure which is, on the one hand, very complex and thus expensive, and ultimately does not actually solve the problem because over time even the hardened parts cannot withstand the rubbing strain, e.g. by sand contained in the lubricant, over a long period. A further point is that, for example, also the width of the lubricant gaps between the rotating and/or static parts of the bearings can often not be reduced to the desired degree because otherwise the harmful influence of hard, non-compressible ingredients such as sand would become so great that a premature wear of the corresponding bearings would become unavoidable. Since the bearing gaps cannot be ideally set by such restrictions, the running smoothness of the supported parts can be negatively influenced and damaging vibrations can occur in the operating state due to non-ideally set lubricant gaps, which can ultimately likewise result in a premature wear.

A further apparatus known from EP 12 154 903.4 provides for separating the pump fluid by means of a separation device. In thus process, the liquid and solid ingredients of the pump fluid are separated from one another and the liquid portions are utilized as lubricant for lubricating rotating parts of the pumps, in particular for lubricating the rotor shaft of the pump motor.

It is a disadvantage of the described apparatus that only solid or liquid ingredients can be separated, even though also gaseous ingredients negatively influence the lubricating behavior of the lubricant because, for example, the viscosity, that is the sluggishness of the pump fluid used as a lubricant is poorly suitable or is not at all suitable for the use as a lubricant.

It is therefore the object of the invention to propose a pump for conveying a pump fluid in the form of a multiphase mixture in which the pump fluid can simultaneously be used for lubricating rotating parts of the pump, in particular for lubricating the rotor shaft of the pump rotor, with the harmful influences of the ingredients on the lubricating process known from the prior art being very largely avoided.

The subject matters of the invention satisfying this object are characterized by the features of the independent claims 1 and 14.

The dependent claims relate to particularly advantageous embodiments of the invention.

The invention thus relates to a pump for conveying a pump fluid in the form of a multiphase mixture, wherein the pump fluid provided at an input pressure at a low-pressure side of the pump in the operating state can be conveyed by means of a pump rotor rotatably supported about an axis of rotation in a pump stator to a high-pressure side of the pump and a rotor shaft is arranged in a shaft leadthrough such that a lubricating film of a lubricating fluid formed from the pump fluid can be formed in a ring gap between the rotor shaft and the shaft leadthrough and a separation device is provided at the rotor shaft by which a predefinable quantity of an ingredient can be separated from the pump fluid by means of a centrifugal force in the operating state to provide the lubricating fluid at the ring gap. In accordance with the invention, a recirculation device is provided so that a gas can be recirculated with the aid of the separation device.

It is thus essential for the invention that a recirculation device is provided by which a predefinable quantity of a gas, frequently natural gas in practice, can be recirculated in the operating state. The gas which can be separated from the pump fluid is substantially separated from the pump fluid with the aid of the separation device and in particular by means of the centrifugal force acting in the separation device. For this purpose, the pump fluid to be conveyed through the pump can be a multiphase mixture which includes crude oil and natural gas charged with sand and which is conveyed, for example, by the pump from a raw source into a reservoir.

The pump fluid is in this respect exposed in the rotating separation device to the centrifugal forces acting there due to the rotation. Due to the higher density of the sand in comparison with the liquid and gaseous portion of the pump fluid, with the gaseous portions in turn having a lower density than the liquid portions, the sand is deposited in this respect under the effect of the centrifugal force at the outer margin, the liquid portions are deposited at the center and the gaseous portions are deposited in the interior, for example in a ring chamber of the separation device. A further cause for the separation of the gas from the pump fluid is, for example, the pressure difference between the recirculation device and the high-pressure side of the pump. In this respect, the pump fluid flows from the high-pressure side of the pump to the recirculation device, that is in the direction of a gas sink, where the gas is separated from the pump fluid and flows off again from there in a specific direction, preferably in the direction of the high-pressure side of the pump.

A phase of the pump fluid is thereby formed in the interior of the ring chamber which has high gas deposits and which is preferably led off back to the high-pressure side of the pump by means of a recirculation device in accordance with the invention and pump fluid not having gas deposits is used for the lubrication, e.g. of the rotor shaft. The removal of the lubricating fluid which should be used for the lubrication in this respect takes place at a further outwardly disposed diameter of the ring chamber of the separation device where a phase of the pump fluid with a low gas and sand concentration has collected. A phase of the pump fluid with high sand deposits is formed at the outer margin of the ring chamber of the separation device and is preferably led off from there back to the low-pressure side of the pump via a corresponding separation line and is not used for the lubrication, e.g. of the rotor shaft.

It is self-explanatory that any desired ingredients of the pump fluid which have the corresponding density differences can be separated in this manner using the separation device and the gaseous portions can preferably be recirculated on the high-pressure side by the recirculation device so that, for example, the portion of the pump fluid which should be used for lubrication has a predefined suitable viscosity which is not too high or too low because gaseous portions can be removed using the recirculation device and with the aid of the separation device.

It is thus possible for the first time by the present invention not only to separate, and recirculate by means of the recirculation device, solid or liquid ingredients, but also gaseous ingredients which have a negative influence on the lubricating behavior from the pump fluid to be conveyed such that a phase of the pump fluid purified from the ingredients to a sufficient degree is provided which can be used for lubricating rotating parts of the pump, with the harmful influences of the ingredients on the lubricating process known from the prior art being very largely avoided. In this respect, depending on the exact composition and consistency of the pump fluid or of the ingredients, mixing phenomena or solution phenomena can, for example, also become relevant which can further positively influence the process of recirculation. It is thus possible, for example, that gas portions are dissolved in higher viscosities and/or in fluid components of higher density or are enclosed, for example, in the form of bubbles, and are thus likewise co-separated and recirculated by the recirculation device in accordance with the invention. Other processes known per se can naturally also contribute to the fact that not only components of lower density can be separated via the recirculation device, but also those with higher density because they are taken along by the components of higher density.

As a particular measure, the shaft leadthrough forms a shaft bearing and includes a stationary bushing and a rotating shaft sleeve, with the ring gap being able to be formed between the stationary bushing and the rotating shaft sleeve. The shaft leadthrough advantageously specifically forms a constriction point.

The advantage of this measure is that the constriction points, that is ring-shaped seals which serve for the separation of pressure stages, constantly lubricate and stabilize the rotor and serve for the pressure separation so that the rotor is constantly only lubricated by liquid during its revolving movement The recirculation device includes a feed line, a recirculation line and a means to increase pressure, in particular a screw conveyor and/or a grooved line. In an embodiment particularly preferred for practice, the means for increasing pressure are, for example, located in the recirculation line, i.e. the line is partly or fully grooved in the interior and/or has a screw conveyor so that the pressure in the recirculation line is, as the skilled person will immediately understand, increased in a manner similar to the effect of a constrictor via the pressure of the high-pressure side of the pump or of a gas sink. In addition, the recirculation device is flow-connected to the high-pressure side of the pump to supply the pump fluid into the recirculation device by means of a feed line so that the pump fluid flows from the high-pressure side of the pump to the recirculation device in the operating state. For the recirculation of the gas, the recirculation device is flow-connected to the high-pressure side of the pump and/or to a gas sink via a recirculation line. The recirculation line is in this respect designed such that a pressure in the recirculation device can be made higher by means of the means to increase pressure than on the high-pressure side of the pump and/or of the gas sink and the gas can be conveyed by the recirculation device to the high-pressure side and/or to the gas sink, with the gas sink to be understood, for example, as a region for collecting the gas, a gas collection container or a line which conducts the gas into a region outside the pump.

The recirculation device is in this respect formed as an integral component of the pumps. The feed line and the recirculation line can, for example, be an integral component of the pump housing, in particular a bore or a bore-like connection opening extending in the pump housing or pump stator or in the shaft leadthrough, but can also be realized by separate lines which connect the high-pressure side to the recirculation device and/or to the separation chamber.

The separation device co-rotating about the axis of rotation with the rotor shaft specifically includes a ring chamber at which ring chamber a separation opening is provided, which is preferably aligned tangentially, for separating the ingredient. As a preferred measure, the separation device includes a first separation opening for separating the gas and/or a second separation opening for separating an ingredient and/or a third separation opening for separating the lubricating fluid. The first separation opening is flow-connected to the recirculation device and/or to the recirculation line for separating the gas, whereas the second separation opening is flow-connected by means of a separation line to the low-pressure side of the pump by means of a separation line for leading off the ingredient.

Since the ingredients to be separated have different densities, a phase of the pump fluid with high gas deposits is formed at the first separation opening in the interior of the ring chamber of the separation device. The removal of the lubricating fluid which should be used for the lubrication in this respect takes place at the third separation opening at a further outwardly disposed diameter of the ring chamber of the separation device where a phase of the pump fluid with a low gas concentration and sand concentration has collected. A phase of the pump fluid with high sand deposits is formed at the outer margin of the ring chamber of the separation device and is preferably led off from there back to the low-pressure side of the pump via a corresponding separation line and is not used for the lubrication, e.g. of the rotor shaft.

In this respect, the recirculation line and separation line can naturally also be integral components of the pump housing and can in particular be bores or bore-like connection openings extending in the pump housing or in the pump stator; or the recirculation line and separation line can also be realized by separate lines which connect the separation openings of the separation device to the recirculation device/recirculation line and/or to the low-pressure side of the pump or to other points having low pressure.

So that, for example, the shaft leadthrough in which the rotor shaft of the pump is supported or the ring gap between the stationary bushing and the rotating shaft sleeve can be ideally supplied with the phase of the pump fluid purified from the ingredient for the lubrication, the ring gap is flow-connected by means of a lubricant opening to the third separation opening of the separation device such that the lubricating fluid at least partly liberated from the ingredient can be supplied to the ring gap via the lubricant opening for lubricating the shaft leadthrough.

In a specific embodiment variant, an additional lubricant line can be provided such that a predefinable quantity of lubricating fluid can be removed from the separation device and can in particular be used for feeding a further lubricating point of the pump. In this respect, the lubricant line can naturally also specifically be an integral component of the pump housing, in particular a bore or bore-like connection opening extending in the pump housing or pump stator, or the lubricant line can also be realized by a separate line which connects the separation device of the separation chamber to the further lubricating point in the pump.

Depending on the application and the embodiment, the separation device can either be releasably connected to the rotor shaft, with the separation device in particular being able to be designed as a separation disk which can be screwed to the rotor shaft. In this respect, it is naturally also possible that the separation device is an integral component of the rotor shaft, with the separation device in particular being able to be a separation disk integrally connected to the rotor shaft.

The invention further relates to a recirculation device for a pump in accordance with the invention.

Figure 2:
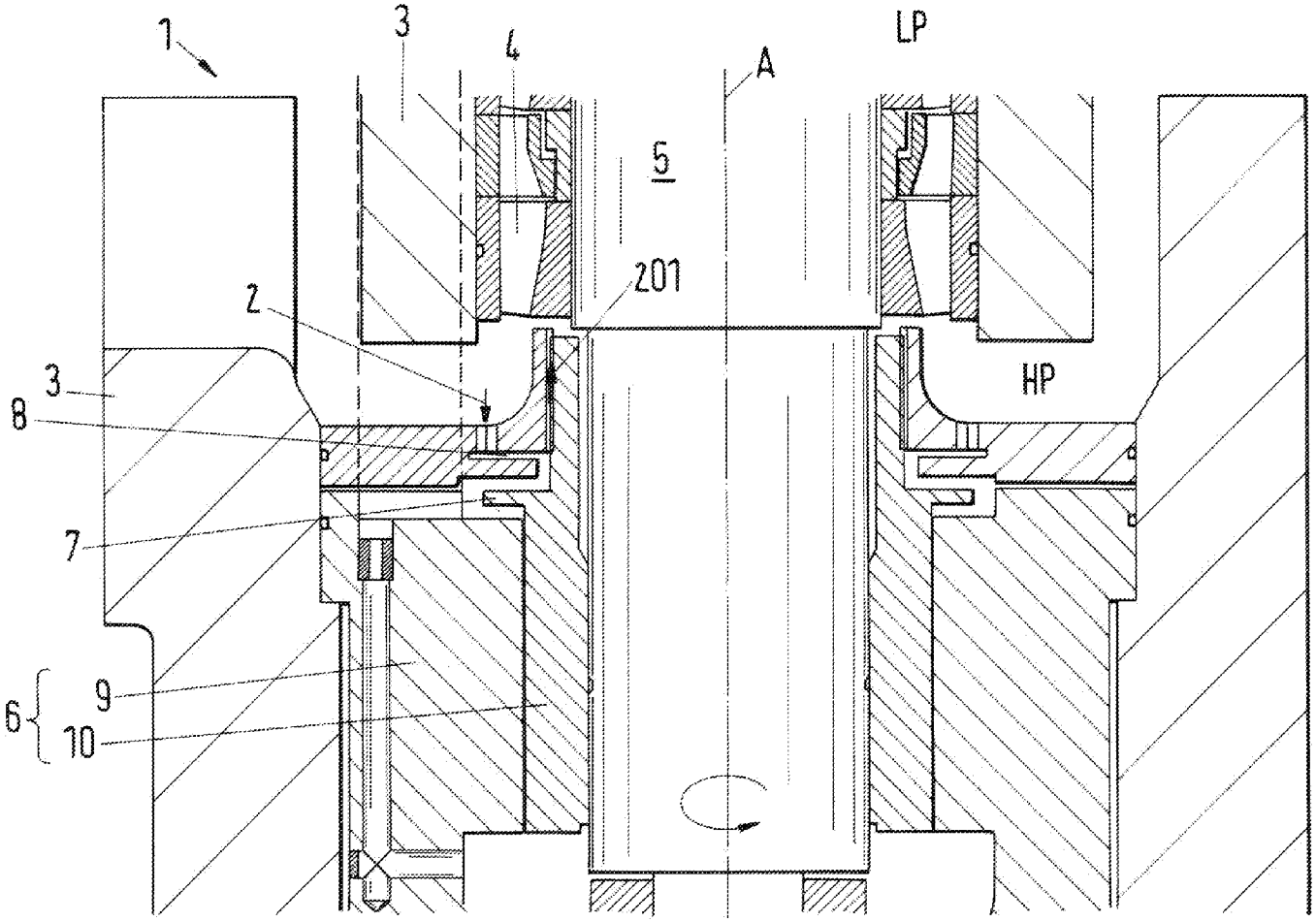
Figure 3:
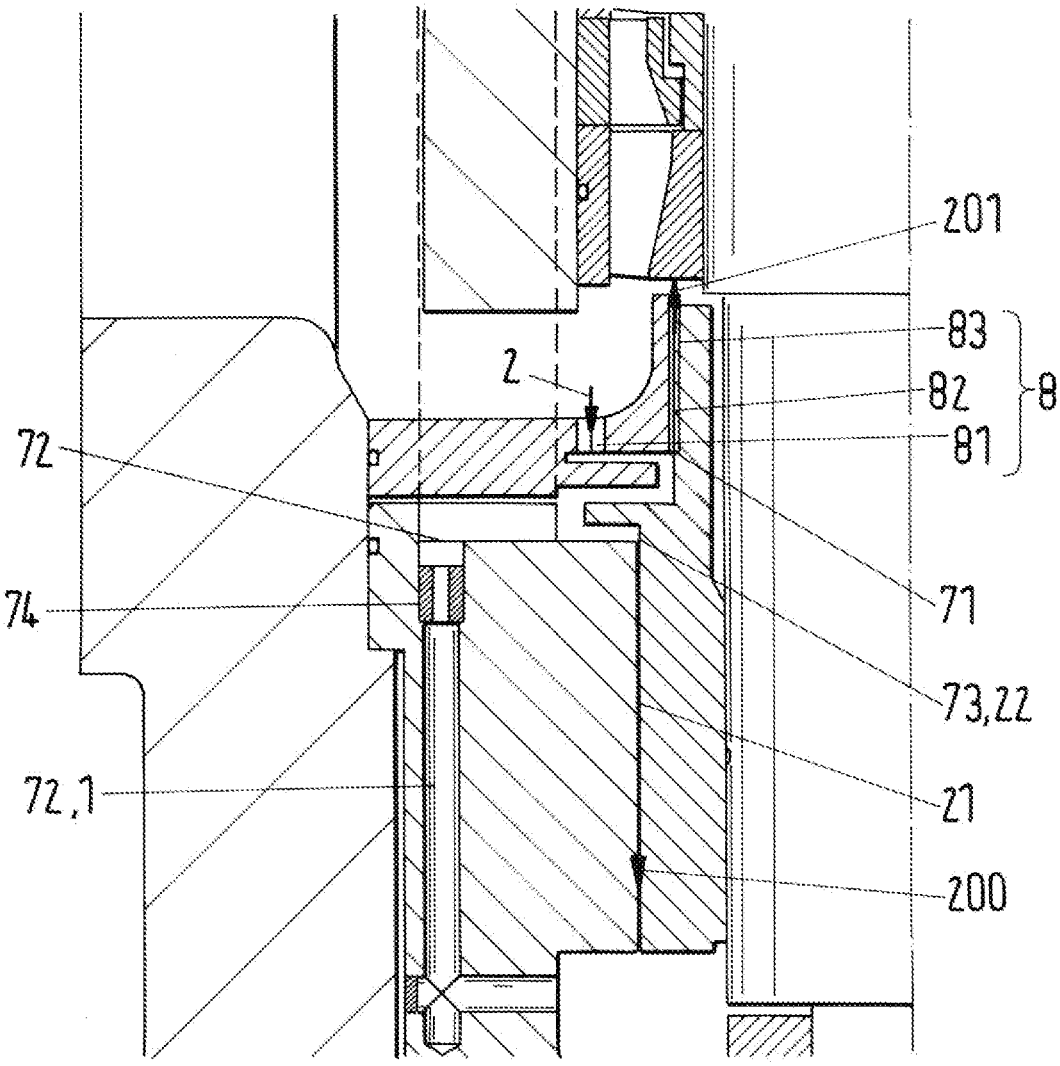

The invention will be explained in more detail in the following with reference to the drawing. There are shown in a schematic representation:

FIG. 1 the prior art for the example of a pump with a separation disk;

FIG. 2 an embodiment of a pump in accordance with the invention with a recirculation device; and FIG. 3 a detailed representation of an embodiment of a pump in accordance with the invention with a recirculation device.

It applies to the following description of the Figures that all the reference numerals which refer in the examples to the features of the prior art are provided with a dash and all the reference numerals which refer to embodiments in accordance with the invention are not marked by a dash.

FIG. 1 shows the prior art with reference to a pump, with the design of the shaft leadthrough with a separation device being shown somewhat more exactly in detail. The pump, which is designated by the reference numeral 1' as a whole in the following serves very generally for the conveying of a pump fluid 2' in the form of a multiphase mixture, i.e. the multiphase mixture is composed of different solid, liquid and gaseous ingredients. The ingredients are substantially sand and gas which are present in the pump fluid 2' as pollutants in non-tolerable quantities. The pump fluid 2' is crude oil here which is available at a low-pressure side LP' of the pump 1' at an inlet pressure and which is conveyed to a high-pressure side HP' of the pump 1' by means of a pump rotor (not shown) rotatably about an axis of rotation A' in accordance with the arrow P' supported in a pump stator (not shown) in the operating state. The pump rotor is in this respect designed and is arranged above a rotor shaft 5' in a shaft leadthrough 6' such that a lubricating film of a lubricating fluid 200' formed from the pump fluid 2' can be formed in a lubricating ring gap 21' between the rotor shaft 5' and the shaft leadthrough 6'. It can additionally be seen that a separation device 7' is provided at the rotor shaft 5' by which a predefinable quantity of the ingredient can be separated from the pump fluid 2' by means of a centrifugal force in the operating state for providing the lubricating fluid 200'.

As shown schematically in FIG. 1, the separation device 7', which is here designed as a separation disk screwed to the rotor shaft 5' of the pump 1' by screws 70', is connected to the high-pressure side HP' of the pump 1' via a feed line for supplying the pump fluid 2', that is here the crude oil, including the ingredient. The separation disk is in this respect covered by a cover D' through which the pump fluid 2' is supplied to the separation disk.

As shown in detail in FIG. 1, the separation disk co-rotating with the rotor shaft 5' about the axis of rotation A' includes a ring chamber, with at least one substantially tangentially aligned separation opening being provided at the ring chamber for separating the ingredients. The separation opening is connected via a separation line 721' to the low-pressure side LP' of the pump 1' for leading off the separated ingredient, that is in the present example for leading off the sand deposited in the crude oil. In this respect, the sand has a higher density than the lubricating fluid 200' which is finally used for lubricating the rotor shaft 5'.

So that the lubricating fluid 200' can be provided for lubricating the rotor shaft 5' in the shaft leadthrough 6', the lubricating ring gap 21' is flow-connected to the separation device 7' by means of a lubricant opening 22' such that the lubricating fluid 200' at least partly liberated from sand can be supplied to the ring gap 21' via the lubricant opening 22' for lubricating the shaft leadthrough 6'.

A lubricant line 10' is furthermore additionally provided such that a predefinable quantity of lubricating fluid 200' can be led off by the separation disk, in particular for feeding a further lubricating point of the pump 1', which additional lubricating points are not explicitly shown for reasons of clarity. In this respect, the lubricating fluid 200' branched off via the lubricant line 10' is used for lubricating further plant parts which are disposed outside the pump 1' or which are not part of the pump 1'.

As already mentioned, the separation device 7', that is here the separation disk, is releasably connected to the rotor shaft 5'; however, it is also possible that the separation device 7' is an integral component of the rotor shaft 5' and the separation device 7' is in particular a separation disk integrally connected to the rotor shaft 5'.

The pump in accordance with the invention serves very generally, and in particular in the specific embodiment of FIG. 2 and FIG. 3, for the conveying of a pump fluid in the form of a multiphase mixture. The pump, which is designated by the reference numeral 1 as a whole in the following serves very generally for the conveying of a pump fluid 2 in the form of a multiphase mixture, i.e. the pump fluid is composed of different solid, liquid and gaseous ingredients. The ingredients are substantially sand and gas which are present in the pump fluid 2 as pollutants in non-tolerable quantities. The pump fluid 2, for example crude oil, which is available at an input pressure at a low-pressure side LP of the pump 1 and which can be conveyed to a high-pressure side HP of the pump by means of a pump rotor 4 rotatably supported about an axis of rotation A in accordance with the arrow P in a pump stator 3 in the operating state and a rotor shaft 5 is arranged in a shaft leadthrough 6 such that a lubricating film of a lubricating fluid 200 formed from the pump fluid 2 can be formed in a ring gap 21 between the rotor shaft 5 and the shaft leadthrough 6. In addition, a separation device 7 is provided at the rotor shaft 5 by which a predefinable quantity of an ingredient can be separated from the pump fluid 2 by means of a centrifugal force in the operating state for providing the lubricating fluid 200 at the ring gap 21. In accordance with the invention, a recirculation device 8 is provided so that a gas 201 can be recirculated with the aid of the separation device 7.

As shown schematically in FIG. 2, the shaft leadthrough 6 includes a stationary bushing 9 and a rotating shaft sleeve 10. The ring gap 21 can in this respect, as in the present embodiment, be formed both between the stationary bushing 9 and the rotating shaft sleeve 10 and directly between the rotor shaft 5 and the shaft leadthrough 6.

In addition, the recirculation device 8 shown in FIG. 2 includes a feed line 81, a recirculation line 82 and a means to increase pressure 83, in particular a screw conveyor and/or a grooved line. The recirculation device 8 is flow-connected to the high-pressure side HP of the pump by means of the feed line 81 for supplying the pump fluid 2 so that the pump fluid 2 flows from the high-pressure side HP of the pump to the recirculation device 8.

The separation device 7 and/or the separation disk co-rotating with the rotor shaft 5 about the axis of rotation A in detail includes a ring chamber, at which ring chamber a preferably tangentially aligned separation opening is provided for separating the ingredient. In the present embodiment, which is particularly preferred, the separation device 7 or the separation disk includes a first separation opening 71 for separating the gas 201 and/or a second separation opening 72 for separating an ingredient and/or a third separation opening 73 for separating the lubricating fluid.

So that the separated gas 201 is separated into the recirculation device 8 and/or into the recirculation line 82, the first separation opening 71 for separating the gas 201 is flow-connected to the recirculation device 8 and/or to the recirculation line 82. For recirculating the gas 201, the recirculation device 8 is flow-connected to the high-pressure side HP of the pump and/or to a gas sink by means of the recirculation line 82. The means to increase pressure 83 are in this respect required to generate a pressure in the recirculation line 82 which is higher than on the high-pressure side HP of the pump and/or of the gas sink so that the gas 201 can be conveyed by the recirculation device 8 to the high-pressure side HP of the pump and/or to the gas sink. As already mentioned, the recirculation device 8 is formed as an integral part in the pump stator 3; however, it is also possible that the recirculation device 8 is an external recirculation device 8 releasably connected to the pump.

So that the lubricating fluid 200 can be provided for lubrication, the ring gap 21 is flow-connected to the third separation opening 73 of the separation device 7 by means of a lubricant opening 22 such that the lubricating fluid 200 at least partly liberated of the ingredient can be supplied to the ring gap 21 via the lubricant opening 22 for lubricating the shaft leadthrough 6.

A lubricant line is furthermore additionally provided such that a predefinable quantity of lubricating fluid 200 can be led off by the separation disk, in particular for feeding further lubricating points of the pump 1 which additional lubricating points are not explicitly shown for reasons of clarity. In this respect, the lubricating fluid 200 branched off via the lubricant line is used for lubricating further plant parts which are disposed outside the pump 1 or which are not part of the pump 1.

The second separation opening 72 is connected via a separation line 721 to the low-pressure side LP of the pump 1 for leading off the separated ingredient, that is in the present example for leading off the sand deposited in the crude oil. In this respect, the sand has a higher density than the lubricating fluid 200 which is used for lubricating the rotor shaft 5.

The separation line 721 is designed as an integral component in the shaft leadthrough 6 or in the pump stator 3, but can also be guided as a separate, additional separation line 721, for example at the outside of the housing of the pump.

As an advantageous measure, a second constriction point 74 is provided which serves for the increase of the resistance to avoid a direct flowing off of the pump fluid 2.

It is understood that all the embodiments of the invention shown only by way of example in the Figures are only to be understood as examples or by way of example and that the invention in particular, but not only, includes all suitable combinations of the described embodiments.

The invention claimed is:

1. A pump for conveying a pump fluid in the form of a multiphase mixture, wherein the pump fluid provided at an input pressure at a low-pressure side of the pump can be conveyed to a high-pressure side of the pump by means of a pump rotor rotatably supported about an axis of rotation in a pump stator in the operating state and a rotor shaft is arranged in a shaft leadthrough such that a lubricating film of a lubricating fluid formed from the pump fluid can be formed in a ring gap between the rotor shaft and the shaft leadthrough; and wherein a separation device is provided at the rotor shaft by which a predefinable quantity of an ingredient can be separated from the pump fluid by means of a centrifugal force for providing the lubricating fluid at the ring gap in the operating state, wherein a recirculation device is provided which separates a gas from the pump fluid in the separation device and recirculates the separated gas to the high-pressure side of the pump with the aid of the separation device.

2. A pump in accordance with claim 1, wherein the shaft leadthrough forms a shaft bearing and a stationary bushing includes a rotating shaft sleeve.

3. A pump in accordance with claim 1, wherein the shaft leadthrough forms a constriction point.

4. A pump in accordance with claim 1, wherein the ring gap can be formed between the stationary bushing and the rotating shaft sleeve.

5. A pump in accordance with claim 1, wherein the recirculation device includes a feed line, a recirculation line and a means to increase pressure, in particular a conveying screw and/or a grooved line.

6. A pump in accordance with claim 5, wherein the recirculation device is flow-connected to the high-pressure side of the pump by means of the feed line for supplying the pump fluid so that the pump fluid flows from the high-pressure side of the pump to the recirculation device in the operating state.

7. A pump in accordance with claim 5, wherein the separation device includes a first separation opening for separating the gas and/or a second separation opening for separating an ingredient and/or a third separation opening for separating the lubricating fluid.

8. A pump in accordance with claim 7, wherein the first separation opening for separating the gas is flow-connected to the recirculation device, specifically to the recirculation line.

9. A pump in accordance with claim 7, wherein the separation device includes the second and third separation openings, and wherein the second separation opening is flow-connected to the low-pressure side of the pump by means of a separation line for leading off the ingredient and/or the ring gap is flow-connected to the third separation opening of the separation device by means of a lubricant opening such that lubricating fluid at least partly liberated from the ingredient can be supplied to the ring gap via the lubricant opening for lubricating the shaft leadthrough.

10. A pump in accordance with claim 5, wherein the recirculation device is flow-connected to the high-pressure side of the pump and/or to a gas sink by means of the recirculation line for recirculating the gas.

11. A pump in accordance with claim 10, wherein the recirculation line is designed such that a pressure in the recirculation line is higher than on the high-pressure side of the pump and/or of the gas sink by means of the means to increase pressure and the gas can be conveyed by the recirculation device to the high-pressure side of the pump and/or to the gas sink.

12. A pump in accordance with claim 1, wherein the separation device co-rotates with the rotor shaft about the axis of rotation and includes a ring chamber, at which ring chamber a separation opening is provided, which is preferably aligned tangentially, for separating the ingredient.

13. A pump in accordance with claim 1, wherein the recirculation device is formed as an integral component in the pump stator.

14. A pump in accordance with claim 1, wherein a lubricant line is provided such that a predefinable quantity of lubricating fluid can be led off from the separation device, in particular for feeding a further lubricating point of the pump.

15. A recirculation device for a pump in accordance with claim 1.

* * * * *